US006913345B2

(12) United States Patent
Parish et al.

(10) Patent No.: US 6,913,345 B2
(45) Date of Patent: Jul. 5, 2005

(54) METHOD AND APPARATUS FOR FIRING NOZZLES IN AN INK JET PRINTER

(75) Inventors: George Keith Parish, Winchester, KY (US); Kristi Maggard Rowe, Richmond, KY (US)

(73) Assignee: Lexmark International, Inc., Lexington, KY (US)

( * ) Notice: Subject to any disclaimer, the term of this patent is extended or adjusted under 35 U.S.C. 154(b) by 90 days.

(21) Appl. No.: 10/393,943

(22) Filed: Mar. 21, 2003

(65) Prior Publication Data

US 2004/0183861 A1 Sep. 23, 2004

(51) Int. Cl.[7] ..... B41J 2/16
(52) U.S. Cl. ..... 347/53
(58) Field of Search ..... 347/53, 40, 41, 347/20, 1, 5, 7, 9, 10, 11, 44, 47, 57, 61, 73–76

(56) References Cited

U.S. PATENT DOCUMENTS 4,521,786 A 6/1985 Bain
4,563,689 A 1/1986 Murakami et al.
4,746,937 A 5/1988 Realis Lue et al.
5,642,142 A 6/1997 Bohorquez
5,880,750 A 3/1999 Takahashi
5,909,228 A 6/1999 Takahashi
5,936,644 A 8/1999 Ono et al.
5,975,667 A 11/1999 Moriguchi et al.
5,975,672 A 11/1999 Wen
5,980,015 A 11/1999 Saruta
5,997,122 A 12/1999 Moriyama et al.
6,422,677 B1 * 7/2002 Deshpande et al. ..... 347/14

* cited by examiner

*Primary Examiner*—Raquel Yvette Gordon
(74) *Attorney, Agent, or Firm*—Taylor & Aust, P.C.

(57) ABSTRACT

A method of firing a plurality of jetting heaters in an ink jet printer includes identifying a first of the jetting heaters to be fired. A second of the jetting heaters to be fired immediately after the firing of the first jetting heater is also identified. Power is simultaneously applied to each of the first jetting heater and the second jetting heater.

17 Claims, 6 Drawing Sheets

METHOD AND APPARATUS FOR FIRING NOZZLES IN AN INK JET PRINTER

BACKGROUND OF THE INVENTION

1. Field of the Invention

The present invention relates to an ink jet printer, and, more particularly, to firing nozzles in an ink jet printer.

2. Description of the Related Art

An ink jet printer typically includes an ink jet printhead assembly having a nozzle plate which is mounted in spaced apart relationship to a printhead. The nozzle plate includes a plurality of ink emitting orifices which are respectively disposed in association with a plurality of heater elements mounted on the printhead. When a particular heater element is actuated or fired, ink disposed adjacent thereto rapidly expands to form a vapor bubble. Ink is expelled through the orifice by the bubble and is jetted onto the print medium.

It is known to improve print quality by applying a short prefire pulse to a heater element in order to raise the temperature of the ink before a fire pulse is applied to the heater element. The fire pulse causes a vapor bubble and jetting of the ink, but the prefire pulse does not. A problem is that the time required to apply the prefire pulse adds to the total printing time and reduces the throughput of the printer. Thus, there is a trade-off between the quality of printing, which benefits from the application of prefire pulses, and the speed of printing, which is decreased by the application of prefire pulses.

It is also known to control the ejection of ink by adjusting, among other factors, the width, i.e., time duration, of driving pulses that are applied to the ink heaters. In general, longer driving pulses result in better print quality. Again, there is a trade-off between the quality of printing, which benefits from longer driving pulses, and printing speed, which benefits from shorter driving pulses.

The speed and print quality of ink jet printers is constantly increasing, although there is an engineering trade-off between these two attributes, as described above. Increasing print speed in many cases implies that there will be a decrease in print quality. This is true because ink bubble formation parameters, which produce better ink drop shapes and thus better print quality, are often compromised to increase print speed. Conversely, an increase in print quality is often achieved at the expense of print speed.

What is needed in the art is a way to either increase print speed without decreasing print quality, or increase print quality without decreasing print speed.

SUMMARY OF THE INVENTION

The present invention provides a method of using a single fire input/output (I/O) to simultaneously raise the energy level in two groups of heaters for different amounts of time. This single fire pulse can be used to fire one group of heaters to ink nucleation and to pre-fire a second group of heaters for a shorter amount of time simultaneously.

The invention comprises, in one form thereof, a method of firing a plurality of jetting heaters in an ink jet printer. A first of the jetting heaters to be fired is identified. A second of the jetting heaters to be fired immediately after the firing of the first jetting heater is also identified. Power is simultaneously applied to each of the first jetting heater and the second jetting heater.

An advantage of the present invention is that increased printing speed and/or improved print quality resulting from a longer fire cycle for prefire and nucleation is provided.

Another advantage is that there is no need to increase I/O (input-output), such as by creating additional fire I/O, in order to implement the method of the present invention.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
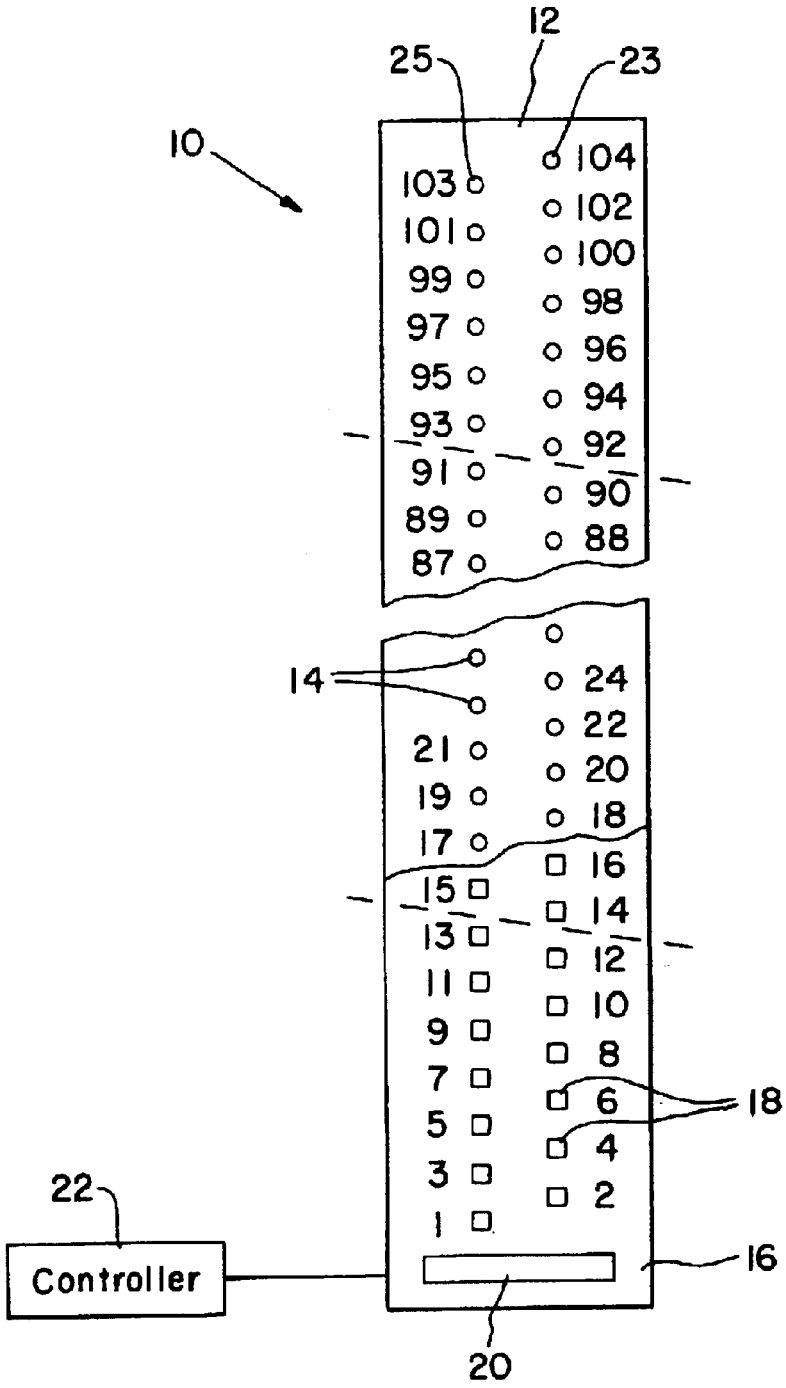
FIG. 1 is a schematic view of an embodiment of an ink jet printhead of the present invention, illustrating a typical configuration of ink emitting orifices and jetting heaters.

Referring now to the drawings, and, more particularly, to FIG. 1, there is shown a printhead 10 including a nozzle plate 12 having a plurality of ink emitting orifices 14 formed therein. Printhead 10 also includes a substrate 16 which is connected to nozzle plate 12. A plurality of jetting heaters 18 are mounted on substrate 16 and positioned relative to respective ink emitting orifices 14. More particularly, each of the plurality of jetting heaters 18 is positioned substantially in axial alignment with a respective ink emitting orifice 14. Actuation of a jetting heater 18 rapidly heats the ink disposed adjacent thereto, and creates a gas bubble which jets ink from the associated ink emitting orifice 14. Jetting heaters 18 are actuated by a printhead chip 20 in response to signals from a controller 22.

Figure 2:
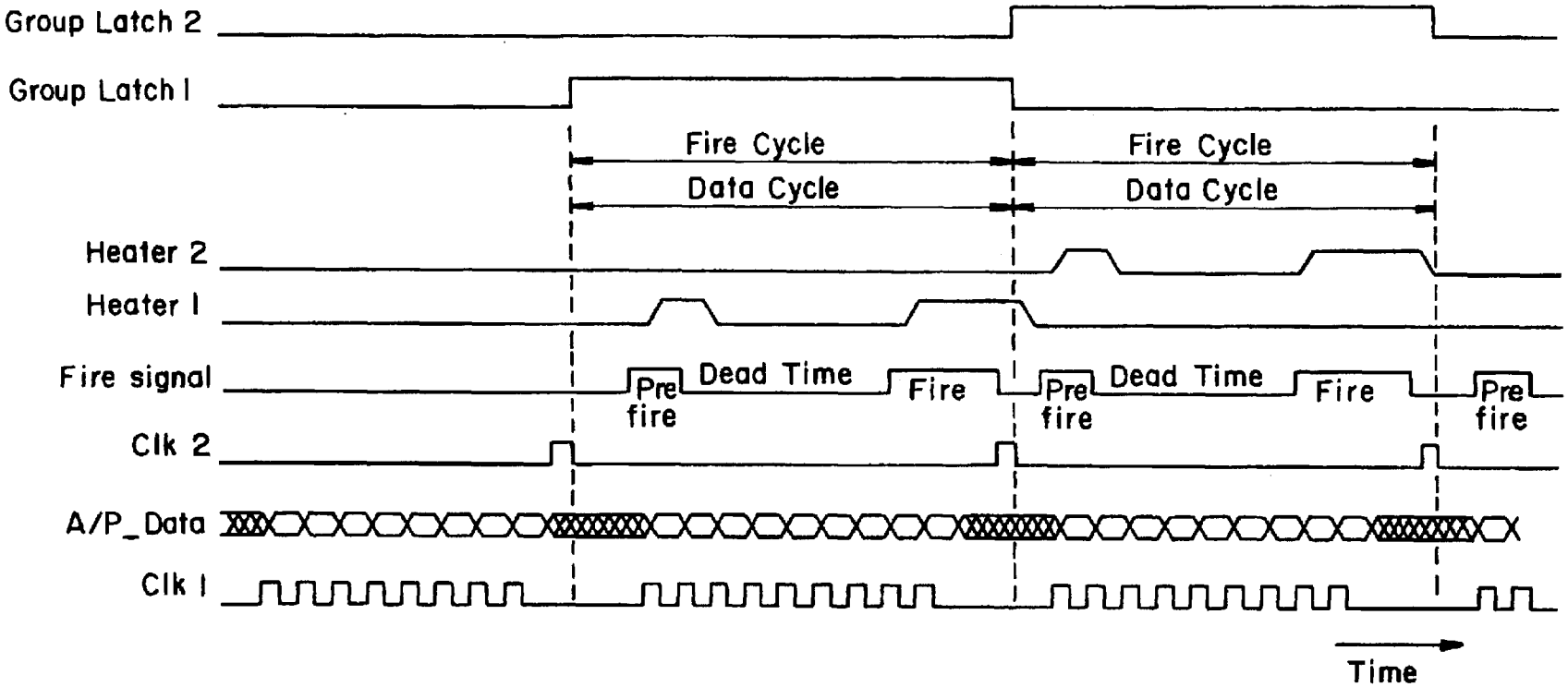
FIG. 2 is a timing diagram of typical serial data produced by an embodiment of the method of the present invention.

Input heater address data is loaded in some serial fashion through one or more shift registers. At a predetermined frequency and bit count, the amount of time required to load the external input data into a shift register and latch the data onto the printhead chip is referred to as the "data cycle", as shown in FIG. 2. The heaters are controlled, i.e., turned on and off, by a cyclical "fire signal". The fire signal is a cyclically repeated series of the following: a short prefire pulse followed by a period of dead time when the heater is not turned on, followed by a longer fire pulse that causes the ink nucleation over the heater. The total of these is referred to as the "fire cycle". Both the data cycle and the fire cycle can be defined by the falling edges of adjacent clock 2 pulses Heater 1 is an example of a heater that fires in a first fire cycle only. That is, an associated first ink emitting orifice 23 is caused to emit ink in response to the firing of Heater 1 in the first fire cycle. Heater 2 is an example of a heater that fires in a second fire cycle only. That is, an associated second ink emitting orifice 25 is caused to emit ink in response to the firing of Heater 2 in the second fire cycle. As can be seen in FIG. 2, adjacent fire cycles do not overlap with each other. The length of the data cycle is set equal to the length of the fire cycle as a compromise between the printer needing to print faster and the fire pulse needing to be longer due to thermal parameter studies of the heater stack.

Figure 3:
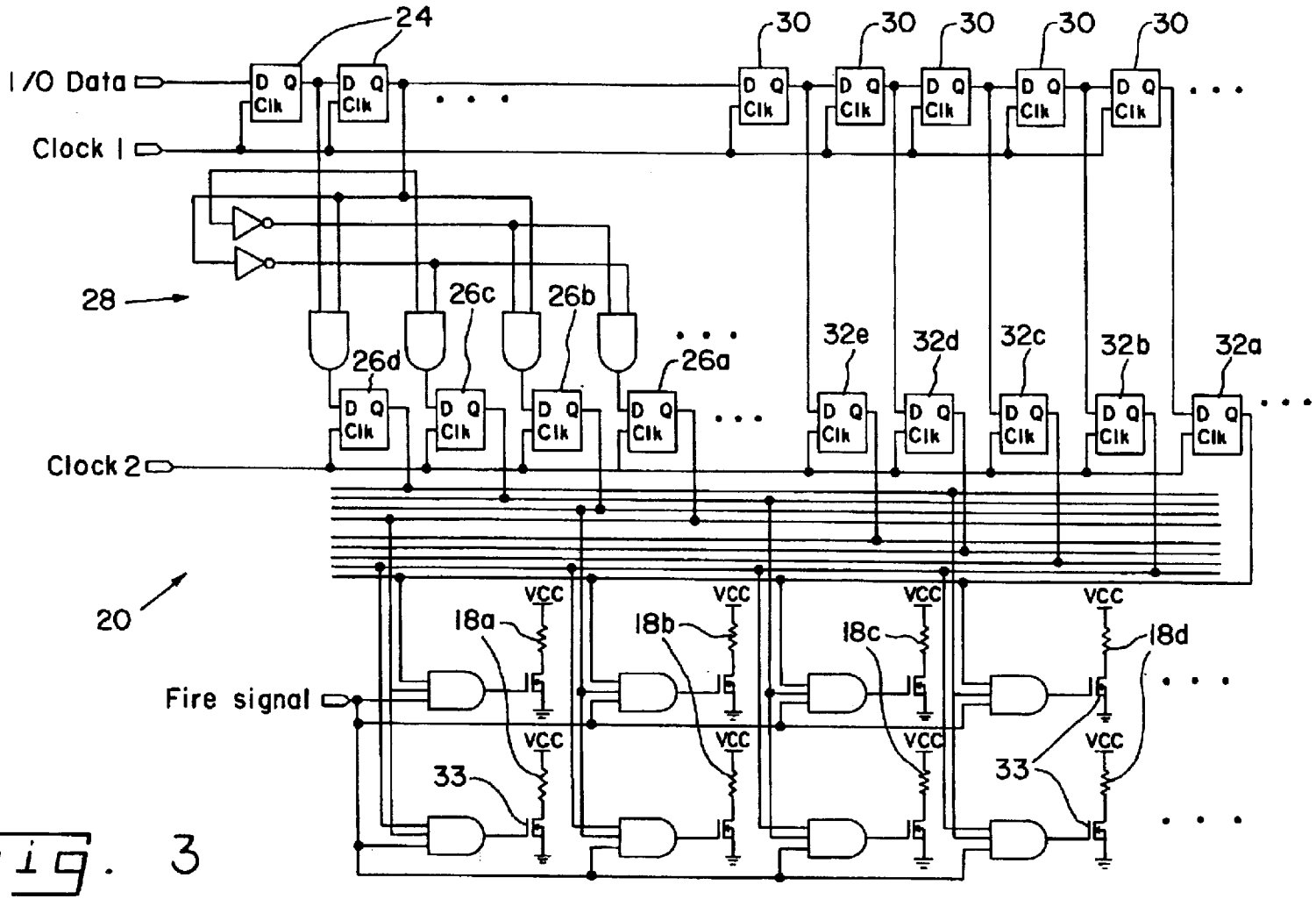
FIG. 3 is a schematic diagram of the printhead chip and heaters of FIG. 1.

FIG. 3 is a schematic view of the circuitry of printhead chip 20 driving jetting heaters 18 as shown in FIG. 2. Only eight jetting heaters 18 and their associated driving circuitry of printhead chip 20 are shown in FIG. 3 for ease of illustration. However, it is to be understood that the circuitry of FIG. 3 can be replicated as many times as necessary to support a desired number of ink emitting orifices 14.

A pair of group data shift registers 24 are used to create four ($2^2$) addresses for heaters 18 at four respective group latches 26 via a decode circuit 28. The number of heaters 18 that can be driven by a common address is determined by how many primitive data shift registers 30 are provided. For example, in FIG. 3, each pair of vertically adjacent heaters 18 is driven by a respective group latch 26 and by two separate primitive latches 32. That is, heaters 18*a* are driven by group latch 26*a* and by primitive latches 32*a* and 32*b*. Thus, the eight heaters 18*a*–18*d* shown in FIG. 3 are driven by the four group latches 26*a*–26*d* and primitive latches 32*a* and 32*b*. In general, the number of heaters that can be driven is equal to the number of group latches 26 multiplied by the number of primitive latches 32. Latches 26, 32 latch the current data state from Clock 2 falling edge to falling edge.

In operation, only one of group latches 26*a*–26*d* produces a logic "1" on its Q output, i.e., goes "high", at any point in time. Thus, only the heaters 18 associated with the "high" group latch 26 can be turned on at any point in time. For example, if group latch 26*a* is high, only heaters 18*a* can be turned on. Whether one, both or neither of heaters 18*a* is actually turned on is determined by the outputs of primitive latches 32*a* and 32*b*. When group latch 26*a* goes "low", i.e., produces a logic "0" on its Q output, group latch 26*b* can then go high, allowing heaters 18*b* to be turned on. Group latches 26*a*–26*d* go high and low in sequence, i.e., latch 26*a* goes high then low, latch 26*b* goes high then low, latch 26*c* goes high then low, and finally latch 26*d* goes high then low. This sequence is then cyclically repeated.

As can be seen in FIG. 2, there is a delay between a rising edge of a prefire pulse or a fire pulse and a heater being turned on. Likewise, there is a delay between a falling edge of a prefire pulse or a fire pulse and a heater being turned off. These delays are due to the response time of power transistors 33.

Figure 4:
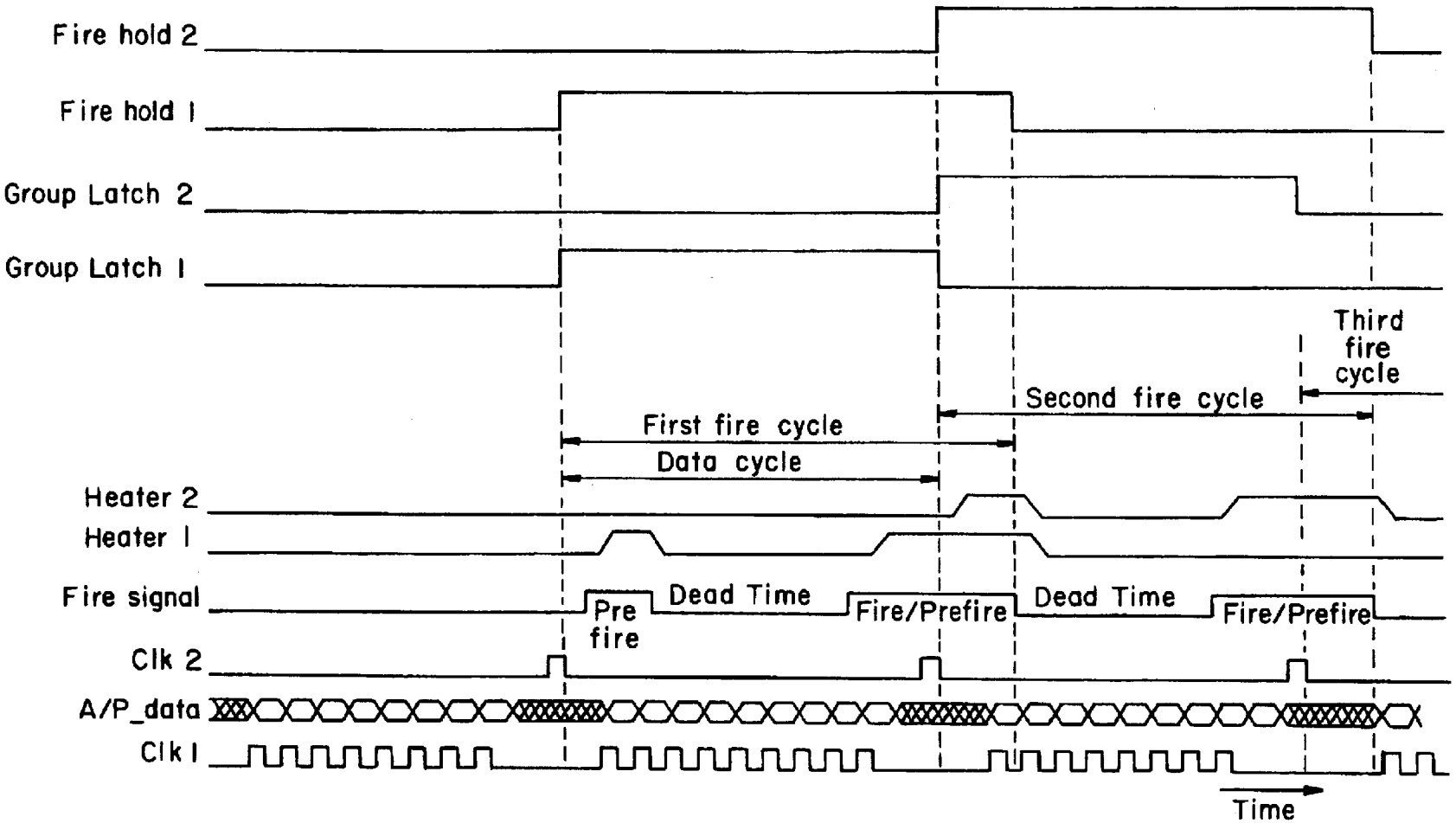
FIG. 4 is a timing diagram of typical serial data produced by another embodiment of the method of the present invention.

A timing diagram of typical serial data produced by another embodiment of the method of the present invention is shown in FIG. 4. In this embodiment, adjacent fire cycles overlap with each other. Power is applied to only Heater 1 immediately before the rising edge of the second clock 2 pulse. Power is simultaneously applied to each of Heater 1 and Heater 2 during the period of overlap between the first fire cycle and the second fire cycle, after the falling edge of the second clock 2 pulse. The merging of the fire pulses with the respective, immediately following prefire pulses causes the overlapping of the first and second fire cycles. As can be seen in FIG. 4, the fire pulse and the prefire pulse of the fire signal are not distinct, as they are in the embodiment of FIG. 2. Rather, the fire pulse is extended into the prefire pulse to form one continuous fire/prefire pulse.

Power continues to be simultaneously applied to Heater 1 and Heater 2 for a short period of time after the end of the first fire cycle due to the response time of power transistors 33, as discussed above. The fire/prefire pulse during the overlap between the first fire cycle and the second fire cycle serves as both a fire pulse for Heater 1 and as a prefire pulse for Heater 2. That is, Heater 1 fires during the first fire cycle, and Heater 2 fires during the second fire cycle.

As can be seen in FIG. 4, there is also an overlap of the second fire cycle and the third fire cycle. The fire/prefire pulse during the overlap between the second fire cycle and the third fire cycle serves as both a fire pulse for Heater 2 and as a prefire pulse for Heater 3. That is, Heater 2 fires during the second fire cycle, and Heater 3 fires during the third fire cycle. Overlapping of adjacent fire cycles continues, with each fire/prefire pulse serving as both a fire pulse for the preceding heater and as a prefire pulse for the succeeding heater.

As illustrated, a fire cycle is longer than a data cycle. Thus, the fire cycle can be set to be longer than the fire cycle of FIG. 2, with the lengths of the data cycles being equal, resulting in better print quality. In FIG. 2, a fire cycle is equal to the time value of:

Pre-fire pulse+dead time+fire pulse.

In FIG. 4, the length of the fire cycle increases by the time value of the pre-fire pulse of the next state. This produces more efficient ink nucleation, and, thus, better formed drops of ink and, in the end, better print quality.

Alternatively, the length of the fire cycle can be set equal to the length of the fire cycle of FIG. 2, with the data cycle being shorter than that of FIG. 2, resulting in faster printing. In FIG. 2, the data cycle, as well as the fire cycle, is equal to the time value of:

Pre-fire pulse+dead time+fire pulse.

The length of the data cycle can be decreased by the time value of the prefire pulse of the next state. This would allow for a faster printing speed.

As a third option, the fire cycle can be made slightly longer and the data cycle can be made slightly shorter than in FIG. 2, resulting in slightly better print quality and slightly faster printing.

Figure 5:
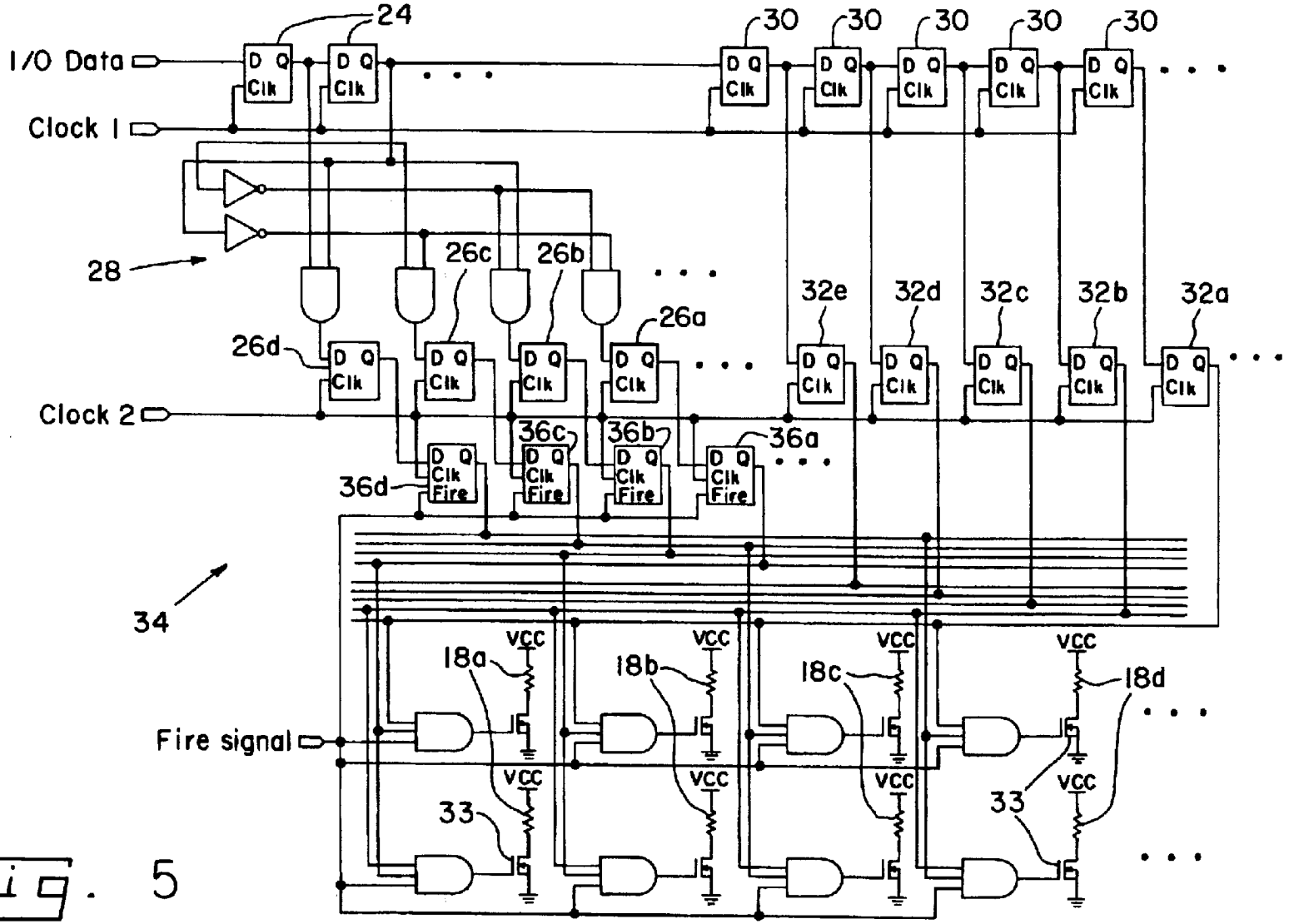
FIG. 5 is a schematic diagram of another embodiment of the printhead chip and heaters.
Figure 6:
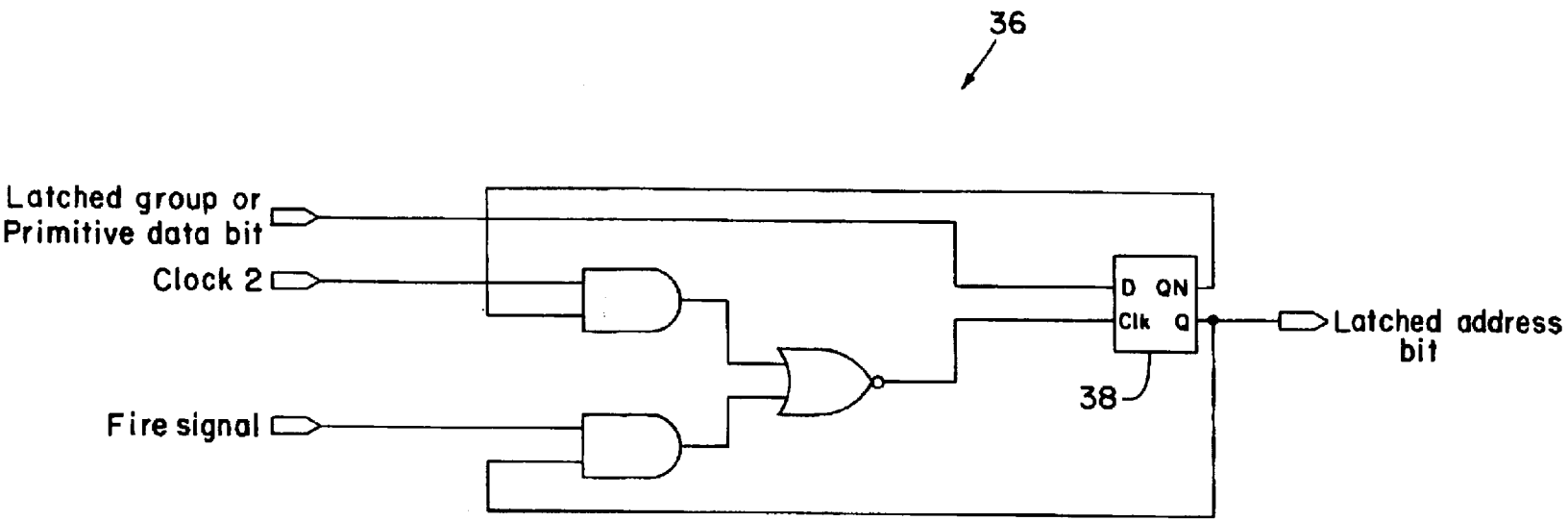
FIG. 6 is a schematic diagram of a fire hold circuit of FIG. 5.

FIG. 5 is a schematic view of the circuitry of a printhead chip 34 driving jetting heaters 18 as shown in FIG. 4. Printhead chip 34 includes fire hold circuits 36, the details of one of which are shown in FIG. 6. The gain in function is achieved by triggering an extra latch 38 for each data bit to hold the state of the bit in order to provide the extended fire cycle time. In order to extend the fire cycle, a second latch 38 is required to hold the past data state, dependent on whether the heater 18 was firing or not. Fire hold circuit 36 makes the decision of whether or not to extend the fire cycle or start a new prefire with every new data set. As seen in FIG. 4, the output of the first fire hold remains high after the first group latch has transitioned from high to low. The second fire hold goes high as soon as the second group latch has transitioned from low to high. Thus, for a short period of time, the outputs of the fire holds are high simultaneously, thereby causing two associated heaters to be turned on simultaneously.

In operation, group latch 26*a* produces a logic "1" on its Q output. In response, fire hold circuit 36*a* produces a logic "1" on its Q output. Group latch 26*a* then goes low and group latch 26*b* goes high, as in the previous embodiment. Fire hold circuit 36*a* does not go low when group latch 26*a* goes low, however. Rather, fire hold circuit 36*a* maintains a logic "1" on its Q output until the falling edge of the fire/prefire pulse. While fire hold circuit 36*a* is maintained in its high state, fire hold circuit 36*b* also goes high in response to group latch 26*b* going high. Thus, power is simultaneously applied to heater(s) 18*a* and heater(s) 18*b*, as shown in the overlap between the first fire cycle and the second fire cycle in FIG. 4. Group latches 26–26*d* go high and low sequentially, as in the previous embodiment. This allows heaters 18*a* and 18*b* to be turned on simultaneously, then heaters 18*b* and 18*c* to be turned on simultaneously, etc.

The logic of FIG. 6 satisfies the statement:

If (Clock 2 has a Falling Edge and (Present State of the Output of the Fire Hold Circuit=0)) or (Fire Signal has a Falling Edge and (Present State of the Output of the Fire Hold Circuit=1))

Then the Output of the Fire Hold Circuit (the Latched Address Bit to the Heater Decode) takes on the value of the Latched Group or Primitive Data Input Else the Output of the Fire Hold Circuit remains at its Present State.

Printhead chip 34 provides the ability to create a longer fire cycle, or shorter data cycle, by simultaneously holding constant a high state of a previous heater address and a high state of a current address during a fire pattern.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of firing a plurality of jetting heaters in an ink jet printer, said method comprising:

identifying a first of the jetting heaters to be fired in a first firing cycle;

identifying a second of the jetting heaters to be fired in a second firing cycle, said second of the jetting heaters being fired immediately after the firing of the first jetting heater, said first firing cycle overlapping said second firing cycle; and simultaneously applying power to each of the first jetting heater and the second jetting heater.

2. The method of claim 1, wherein power is applied to the first jetting heater before power is applied to the second jetting heater.

3. The method of claim 2, wherein the power to the first jetting heater causes an associated first ink emitting orifice to emit ink, the power to the second jetting heater being insufficient to cause an associated second ink emitting orifice to emit ink.

4. The method of claim 2, comprising the further step of providing a clock pulse, power being applied to the first jetting heater before and after the clock pulse, power being applied to the second jetting heater after the clock pulse.

5. The method of claim 1, wherein said step of simultaneously applying power includes supplying a cyclical fire signal.

6. The method of claim 1, wherein said step of simultaneously applying power includes using a fire hold circuit.

7. A method of operating an ink jet printer, said method comprising:

identifying at least one first jetting heater to be fired during a first firing cycle;

identifying at least one second jetting heater to be fired immediately after the firing of the at least one first jetting heater, said second jetting heaters being fired during a second firing cycle, said first firing cycle overlapping said second firing cycle; and simultaneously applying a fire pulse to each of the at least one first jetting heater and the at least one second jetting heater.

8. The method of claim 7, wherein the fire pulse is applied to the at least one first jetting heater before the fire pulse is applied to the at least one second jetting heater.

9. The method of claim 8, wherein the fire pulse to the at least one first jetting heater causes nucleation of ink, the fire pulse to the at least one second jetting heater being insufficient to cause nucleation of ink.

10. The method of claim 8, comprising the further step of providing a clock pulse, the fire pulse being applied to the at least one first jetting heater before and after the clock pulse, the fire pulse being applied to the at least one second jetting heater after the clock pulse.

11. The method of claim 7, wherein said step of simultaneously applying the fire pulse includes supplying a cyclical fire signal.

12. The method of claim 7, wherein said step of simultaneously applying the fire pulse includes using a fire hold circuit.

13. A method of operating an ink jet printer, said method comprising:

at least one of repetitively loading external input data into a shift register and repetitively latching the data onto a printhead chip, said loading and latching steps occurring at a selected frequency defining a data cycle; and controlling a plurality of jetting heaters with a fire signal defining a fire cycle, the fire cycle being longer than the data cycle, the data cycle being reinitiated prior to the end of the firing cycle.

14. The method of claim 13, wherein the fire signal includes a series of fire pulses, each jetting heater being warmed to a first level insufficient to cause ink nucleation by a corresponding leading one of the fire pulses and warmed to a second level sufficient to cause ink nucleation by a trailing one of the fire pulses immediately after the leading fire pulse.

15. The method of claim 14, wherein each said fire pulse serves as a leading fire pulse to at least one of the jetting heaters and as a trailing fire pulse to at least one other one of the jetting heaters.

16. The method of claim 14, wherein each said leading fire pulse comprises a prefire pulse.

17. The method of claim 13, comprising the further step of supplying a clock signal having the selected frequency.

* * * * *